US009435619B1

(12) United States Patent
Park

(10) Patent No.: US 9,435,619 B1
(45) Date of Patent: Sep. 6, 2016

(54) PROPULSION ASSEMBLY FOR A DART-BASED ELECTRICAL DISCHARGE WEAPON

(71) Applicant: Yong S. Park, La Canada, CA (US)

(72) Inventor: Yong S. Park, La Canada, CA (US)

( * ) Notice: Subject to any disclaimer, the term of this patent is extended or adjusted under 35 U.S.C. 154(b) by 0 days.

(21) Appl. No.: 13/680,422

(22) Filed: Nov. 19, 2012

(51) Int. Cl.
*F41B 11/00* (2013.01)
*F42B 6/00* (2006.01)

(52) U.S. Cl.
CPC ..... *F42B 6/003* (2013.01)

(58) Field of Classification Search
USPC ..... 102/502; 361/232; 42/1.08, 1.11, 84; 124/56, 77
See application file for complete search history.

(56) References Cited

U.S. PATENT DOCUMENTS

| | | | | |
|---|---|---|---|---|
| 3,579,964 | A * | 5/1971 | Ohlstein | 222/5 |
| 4,846,044 | A * | 7/1989 | Lahr | 89/1.11 |
| 5,078,117 | A * | 1/1992 | Cover | 124/71 |
| 5,473,501 | A * | 12/1995 | Claypool | 361/232 |
| 5,786,546 | A * | 7/1998 | Simson | 102/438 |
| 5,831,199 | A * | 11/1998 | McNulty et al. | 89/1.11 |
| 6,729,222 | B2 * | 5/2004 | McNulty, Jr. et al. | 89/1.34 |
| 7,042,696 | B2 * | 5/2006 | Smith et al. | 361/232 |
| 7,218,501 | B2 * | 5/2007 | Keely | 361/232 |
| 7,237,352 | B2 * | 7/2007 | Keely et al. | 42/1.08 |
| 7,254,914 | B2 * | 8/2007 | Lund et al. | 42/106 |
| 7,314,007 | B2 * | 1/2008 | Su | 102/502 |
| 7,327,549 | B2 * | 2/2008 | Smith et al. | 361/232 |
| 7,444,939 | B2 * | 11/2008 | McNulty et al. | 102/502 |
| 7,602,597 | B2 * | 10/2009 | Smith et al. | 361/232 |
| 7,800,885 | B2 * | 9/2010 | Brundula et al. | 361/232 |
| 7,891,127 | B2 * | 2/2011 | Cerovic et al. | 42/84 |
| 7,891,128 | B2 * | 2/2011 | Brundula et al. | 42/84 |
| 7,958,662 | B2 * | 6/2011 | Mossberg et al. | 42/70.01 |
| 7,984,676 | B1 * | 7/2011 | Gavin et al. | 102/502 |
| 8,061,073 | B1 * | 11/2011 | Brundula et al. | 42/84 |
| 8,096,076 | B1 * | 1/2012 | Cerovic et al. | 42/84 |
| 8,107,213 | B2 * | 1/2012 | Smith | 361/232 |
| 8,171,850 | B2 * | 5/2012 | Hanchett et al. | 102/501 |
| 8,484,876 | B2 * | 7/2013 | Mossberg et al. | 42/70.01 |
| 8,547,679 | B2 * | 10/2013 | Gavin | 361/232 |
| 2013/0305949 | A1 * | 11/2013 | Hanchett et al. | 102/438 |

* cited by examiner

*Primary Examiner* — Michael David
(74) *Attorney, Agent, or Firm* — Rosenberg, Klein & Lee

(57) ABSTRACT

An assembly for use in propelling electrode darts toward a distant target is deployed in an electrical discharge weapon. The assembly comprises a cartridge having a u-shaped channel terminating in apertures through which wire-tethered darts are propelled. Propulsion is achieved relatively efficiently using the sudden release of compressed gas from a sealed storage tank in response to penetration by a conical penetrator forced by an electrically-induced ignition of a pyrotechnic material to accelerate toward and penetrate the tank at an axial surface. The conical shape of the penetrator and the axial penetration of the tank produces a precisely symmetric rush of gas into a relatively confined volume including the dart channel to propel the darts toward the target in an efficient manner. Paper stickers may cover the dart exit apertures to permit initial pressure buildup before the darts penetrate the stickers as they are propelled toward the target.

6 Claims, 4 Drawing Sheets

PROPULSION ASSEMBLY FOR A DART-BASED ELECTRICAL DISCHARGE WEAPON

BACKGROUND OF THE INVENTION

1. Field of the Invention

The present invention relates generally to the field of non-lethal electrical discharge weapons of the type wherein a pair of electrode tethered darts are propelled toward a remote target to impart a current through the target to temporarily disable the target for capture. The invention relates more specifically to a propulsion assembly for such weapons wherein a small sealed tank holding compressed gas is penetrated at the precise center of an axial surface by a conical penetrator in response to ignition of a pyrotechnic charge.

2. Background Art

The present invention is not the first to incorporate the concept of penetrating a tank of compressed gas to propel electrode darts in an electrical discharge weapon commonly referred to as a Taser. Such devices can help meet or avoid certain regulations and restrictions on weapons which employ ignition of pyrotechnic material more directly as the actual propulsion force. This distinction resides in the use instead of the suddenly released compressed gas as the actual propulsion source and not the more direct pressure from the ignition of the pyrotechnic. U.S. Pat. Nos. 5,078,117 to Cover and 5,786,546 to Simpson, both disclose such devices. Cover's device is rather simple and employs a channeled pin to penetrate the compressed gas container. This approach is fine for one electrode projectile, but does not lend itself to propelling a pair of darts as is done in the present invention. Simpson discloses a configuration which is used for propelling two darts simultaneously. Unfortunately Simpson's disclosure shows a configuration in which the released gas has to fill an entire cartridge interior in order to propel both darts. Such a design suffers from a reduced propulsion efficiency because of the large volume that needs filling in order to build up the internal pressure sufficient to force the darts out of the cartridge with some sufficient level of initial acceleration to reach a remote target. A second potential difficulty is the lack of symmetry in the relation of the darts and the tank of compressed gas which can cause initial instantaneous differences in pressure levels at the two darts which can interfere with dart accuracy and timing. The present invention comprises a compressed gas dart propulsion system which overcomes these deficiencies of the most relevant prior art.

SUMMARY OF THE INVENTION

The present invention comprises an improved assembly for propelling a pair of electrode wire-tethered darts toward a remote target to disable same by electrical pulse discharge. The assembly comprises a cartridge having a u-shaped channel terminating in apertures through which wire-tethered darts are propelled. Propulsion is achieved relatively efficiently using the sudden release of compressed gas from a sealed storage tank in response to penetration by a conical penetrator forced by an electrically-induced ignition of a pyrotechnic material to accelerate toward and penetrate the tank at an axial surface. The conical shape of the penetrator and the axial penetration of the tank produces a precisely symmetric rush of gas into a relatively confined volume including the dart channel to propel the darts toward the target in an efficient manner.

BRIEF DESCRIPTION OF THE DRAWINGS

The aforementioned objects and advantages of the present invention, as well as additional objects and advantages thereof, will be more fully understood herein after as a result of a detailed description of a preferred embodiment when taken in conjunction with the following drawings in which.

DETAILED DESCRIPTION OF A PREFERRED EMBODIMENT

Figure 1:
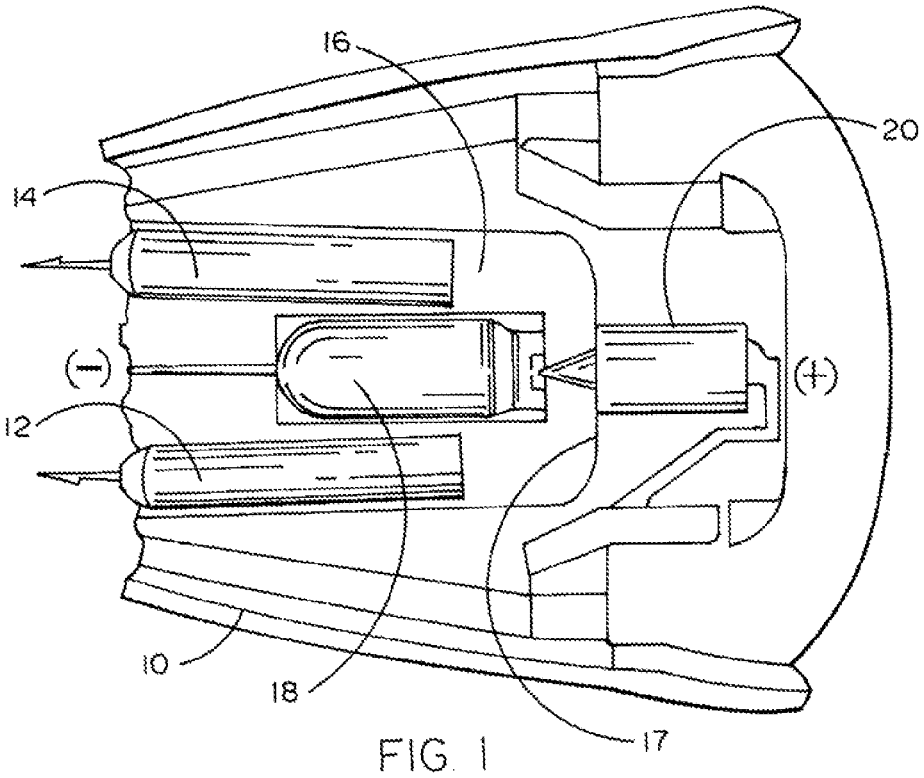
FIG. 1 is a cross-section of the cartridge including the propulsion assembly wherein components are shown in the closed position.
Figure 2:
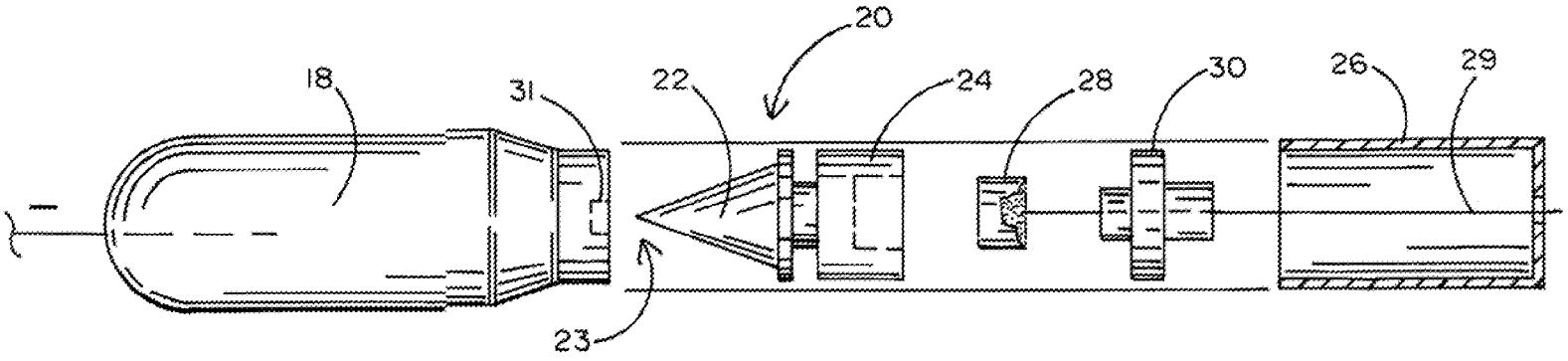
FIG. 2 is a view of the assembly only showing the gas tank at left, the conical penetrator, the powder charge (shown partly open to reveal the powder), the connector, and the empty ignition barrel (shown in section at the extreme right)
Figure 3:
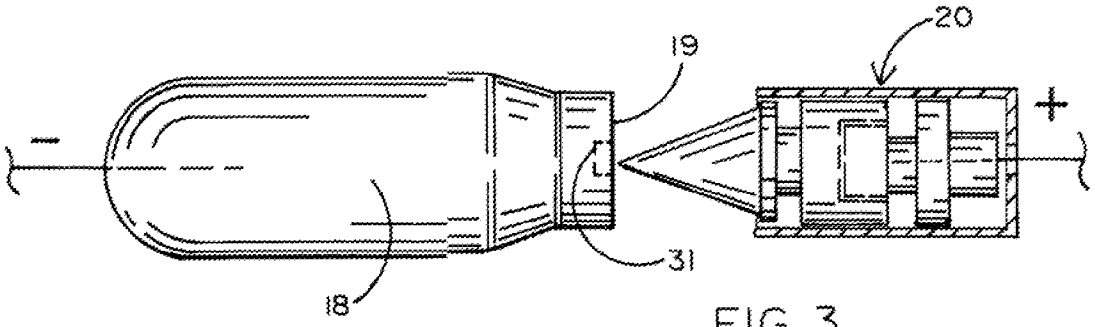
FIG. 3 shows the assembly wherein the barrel at right is shown in section to reveal the inner parts in relation to each other.
Figure 4:
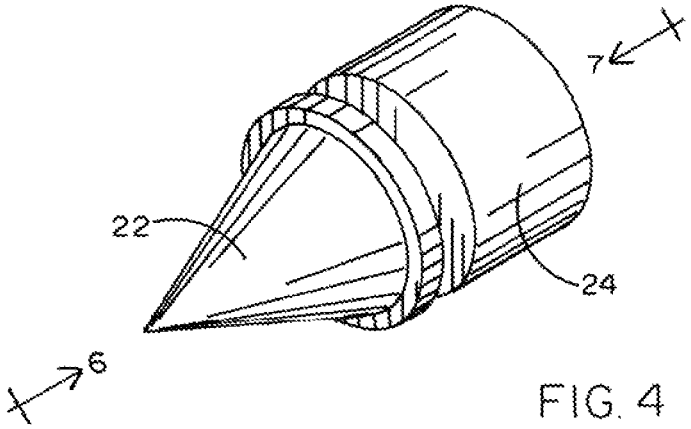
FIG. 4-7 are various views of the conical penetrator components.
Figure 5:
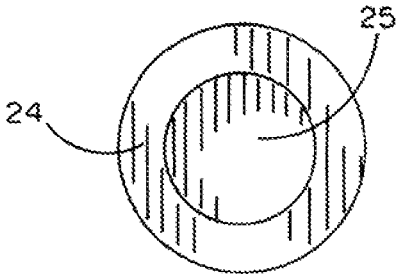
Figure 6:
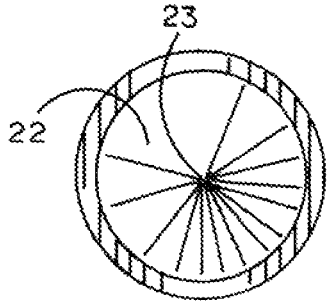
Figure 7:
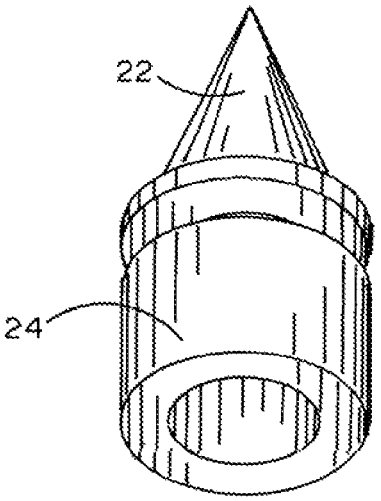

Referring to the accompanying drawings and particularly FIGS. 1-3, it will be see that a preferred embodiment of the present invention comprises a cartridge 10 having a pair of electrode darts 12 and 14 which are normally wire-tethered (but the wires are not shown in order to avoid obfuscation of the invention). The darts 12 and 14 reside in a u-shaped channel 16 which symmetrically encloses a sealed tank 18 holding a quantity of compressed gas which may be for example $CO_2$. One axial surface 19 of tank 18 is in juxtaposition with a penetration assembly 20, the latter shown in detail in FIGS. 2 and 3.

Figure 8:
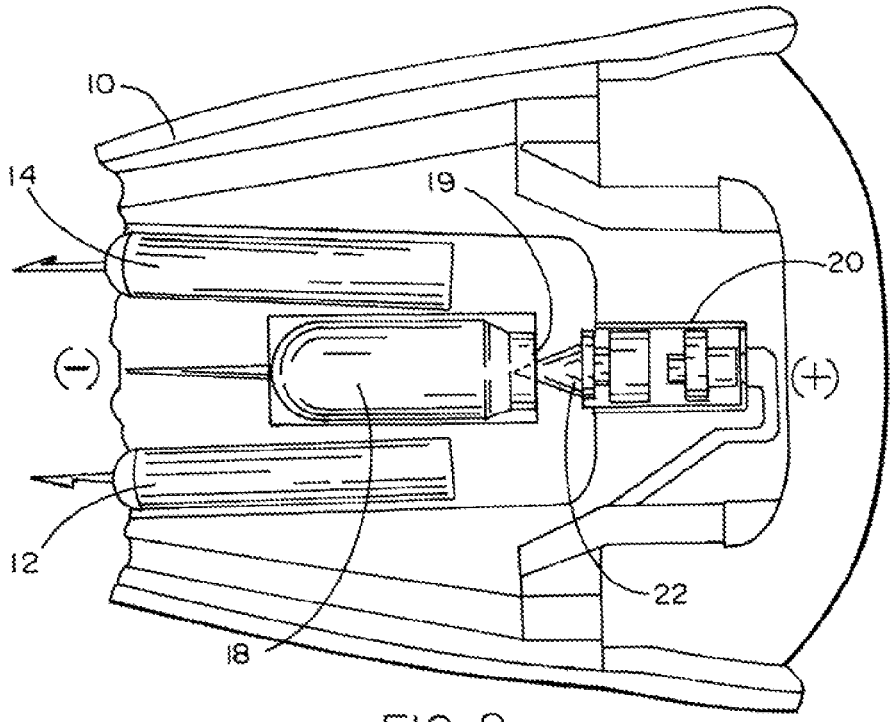
FIG. 8 shows the firing process where the penetrator is driven into the gas cartridge upon detonation of the cartridge.
Figure 9:
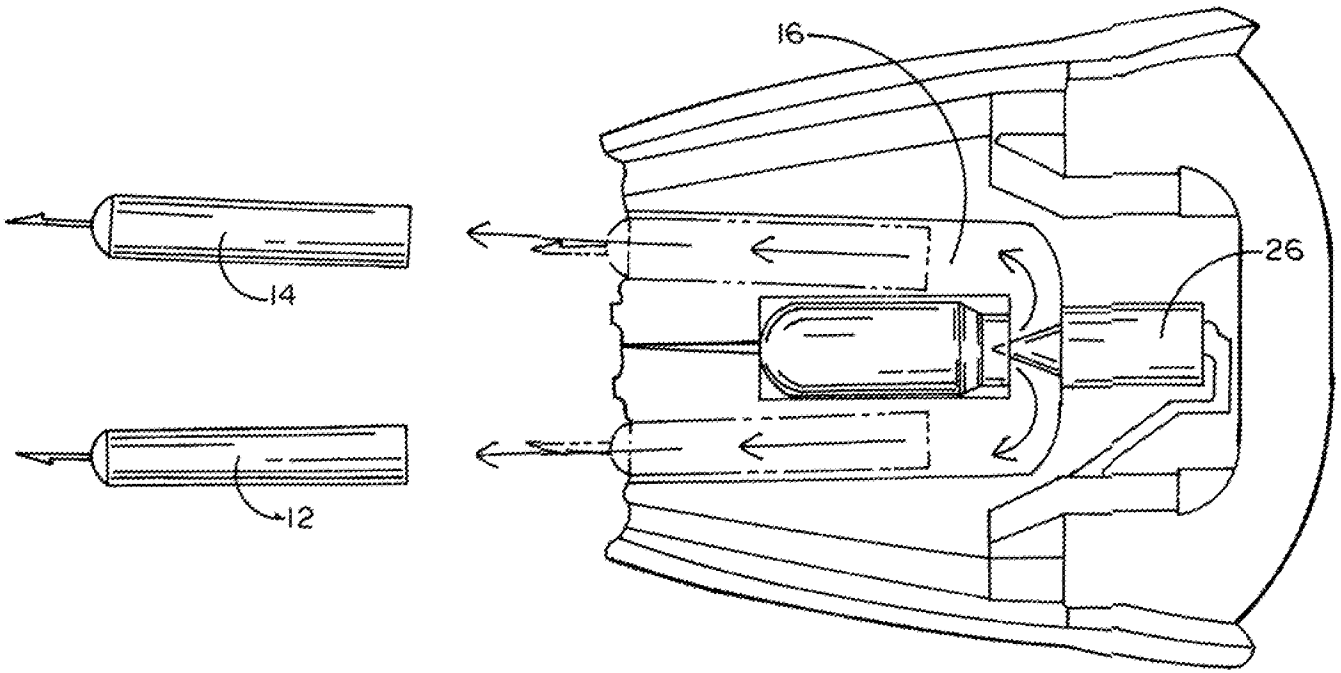
FIG. 9 shows the resultant flow of gas propelling the darts toward a target.

Assembly 20 comprises a conical penetrator 22 which has a sharp conical point 23 at one end and a cylindrical portion 24 at the other as shown best in FIGS. 4-7. Cylindrical portion 24 provides a chamber 25 which receives a cylindrically shaped quantity of pressed pyrotechnic material 28. Material 28 is in intimate contact with an ignition wire 29 which extends through a connector 30 and an ignition housing 26. As shown best in FIG. 3, when fully assembled in the housing 26, the penetrator assembly is a compact cylindrical configuration with penetrator 22 extending from one axial end and an ignition wire extending from the other axial end. The sharp conical point 23 sits immediately adjacent the axial end 19 of tank 18 in a small recess 31 where virtually any movement toward the tank would cause penetration and sudden release of the compressed gas. An important feature of the assembly 20 is that it is positioned with the penetrator end of housing 26 firmly adhered against the channel 16 wall 17 so that upon ignition, the point 23 is thrust through tank end 19 without opening the channel. Consequently, with the cartridge 10 configured as shown in FIG. 8, an application of an electrical voltage to wire 29 across the (+) and (−) terminals shown in FIGS. 1 and 8, the sharp conical point 23 penetrates the tank 18, thereby releasing the compressed gas which suddenly expands into channel 16. This release of gas pressurizes the channel 16 in the manner depicted in FIG. 9, thus propelling darts 12 and 14 out of the cartridge 10.

The symmetrical layout of tank 18 relative to channel 16 and point 23, the penetration of axial end 19 at the precise center thereof and the limited volume of u-shaped channel 16 as a result of the sealing position of housing 26 relative to wall 17, all produce a higher ratio of gas volume to channel volume and a smooth symmetrical pressure increase in both channel chambers simultaneously to improve the efficiency and effectiveness of the propulsion of the darts toward the target. It may also be beneficial to add paper stickers to cover the dart exit apertures to permit some initial pressure buildup before the darts exit the channel by penetrating the stickers.

It will now be understood that the present invention comprises an improved dart cartridge for electrical discharge weapons for disabling remote targets by employing the sudden release of compressed gas by an ignition propelled conical penetrator. The improvements herein reside primarily in a penetrator and dart channel configuration which reduces the volume which the released gas occupies to propel the darts and in the geometry of the compressed gas tank vis a vis the conical penetrator to provide a more symmetrical configuration. The scope hereof is to be limited only by the appended claims and their legal equivalents.

What is claimed is:

1. In a cartridge holding a pair of wire-tethered dart electrodes for propulsion toward a remote target for applying an electric discharge on the target, a propulsion assembly comprising:

a sealed tank of compressed gas positioned symmetrically between opposing sides of a channel holding said dart electrodes;

a penetration assembly having a conical penetrator positioned in substantial juxtaposition with an axial end of said tank;

said penetrator having a chamber receiving a charge of pyrotechnic material within a housing affixed to a wall of said channel;

an electrical voltage selectively applied to said charge for igniting said charge and propelling said penetrator into said tank for releasing said compressed gas into said channel for propelling said dart electrodes.

2. The propulsion assembly recited in claim 1 wherein said conical penetrator is positioned at the center of said axial end of said tank for directing substantially equal gas pressure at each said dart electrode.

3. The propulsion assembly recited in claim 1 wherein said released compressed gas in confined substantially to said channel for efficient propulsion of said dart electrodes.

4. The propulsion assembly recited in claim 1 wherein said released compressed gas is substantially distributed in said channel by said conical penetrator.

5. The propulsion assembly recited in claim 1 wherein said released compressed gas is substantially equally distributed within said channel toward each of said pair of dart electrodes.

6. The propulsion assembly recited in claim 1 wherein said housing of said penetrator assembly substantially seals said channel to resist pressure loss outside said channel upon release of said compressed gas.

* * * * *